United States Patent [19]

Forrest

[11] Patent Number: 4,901,806

[45] Date of Patent: Feb. 20, 1990

[54] APPARATUS FOR CONTROLLED ABSORPTION OF AXIAL AND TORSIONAL FORCES IN A WELL STRING

[75] Inventor: John Forrest, Houston, Tex.

[73] Assignee: Drilex Systems, Inc., Houston, Tex.

[21] Appl. No.: 223,461

[22] Filed: Jul. 22, 1988

[51] Int. Cl.[4] ..... E21B 4/02

[52] U.S. Cl. ..... 175/321; 175/323; 267/113; 267/125

[58] Field of Search ..... 175/297, 321, 323; 188/313; 267/113, 125; 464/26, 180, 183

[56] References Cited

U.S. PATENT DOCUMENTS

| | | | |
|---|---|---|---|
| 3,156,106 | 11/1964 | Crane | 175/323 X |
| 3,323,326 | 6/1967 | Vertson | 175/323 X |
| 3,382,936 | 5/1968 | Galle . | |
| 3,489,231 | 1/1970 | Garrison et al. | 175/323 |
| 3,947,008 | 3/1976 | Mullins | 267/137 |
| 3,949,150 | 4/1976 | Mason et al. | 175/321 |
| 3,998,443 | 12/1976 | Webb | 267/125 |
| 4,051,696 | 10/1977 | Mason et al. | 464/20 |
| 4,055,338 | 10/1977 | Dyer | 267/125 |
| 4,061,295 | 12/1977 | Somm | 244/104 FP |
| 4,120,198 | 10/1978 | Tanguy et al. | 73/151 |
| 4,162,619 | 7/1979 | Nixon, Jr. | 175/321 X |
| 4,186,569 | 2/1980 | Aumann | 175/321 X |
| 4,194,582 | 3/1980 | Ostertag | 175/321 |
| 4,207,756 | 6/1980 | Toelke | 175/299 X |
| 4,221,290 | 7/1980 | Mason et al. | 175/321 |
| 4,257,245 | 3/1981 | Toelke et al. | 175/321 X |
| 4,331,006 | 5/1982 | Bishop | 464/18 |
| 4,387,885 | 6/1983 | Bishop et al. | 267/125 |
| 4,394,884 | 7/1983 | Skipper | 175/321 |
| 4,398,898 | 8/1983 | Odom | 464/20 |
| 4,434,863 | 3/1984 | Garrett | 175/321 |
| 4,502,552 | 3/1985 | Martini | 175/56 |
| 4,739,841 | 4/1988 | Das | 175/61 |
| 4,739,842 | 4/1988 | Kruger et al. | 175/61 |
| 4,739,843 | 4/1988 | Burton | 175/73 |
| 4,776,436 | 10/1988 | Nenkov et al. | 175/321 X |

*Primary Examiner*—William P. Neuder

*Attorney, Agent, or Firm*—Edgar A. Zarins; Malcolm L. Sutherland

[57] ABSTRACT

A drill string apparatus for the controlled absorption of both axial and torsional forces exhibited on the well string during drilling operations. The device is adapted to be connected in the drill string above the drilling tool in order to control the forces acting on the bit and to arrange the mean weight on bit for the selected drilling operation. Generally, the apparatus includes an outer casing coupled at its upper end to the drill string and an inner assembly telescopically received within the outer casing and connected at its lower end to the lower part of the bottom hole assembly or the drilling tool. Rotational torque is transferred from the drill string and outer casing to the inner assembly and drill bit by a series of helical splines. The mean weight on bit is controlled through an interchangeable pressure control nozzle mounted at the top of the inner assembly. Dual pistons with corresponding fluid chambers dampen axial forces while the helical splines decouple the torsional forces from axial vibrations to ensure proper control of the drill bit. In addition to attenuating vibration in conventional drilling operations, the present invention can be utilized in highly deviated holes and in drill strings using coiled tubes.

22 Claims, 2 Drawing Sheets

APPARATUS FOR CONTROLLED ABSORPTION OF AXIAL AND TORSIONAL FORCES IN A WELL STRING

BACKGROUND OF THE INVENTION

I. Field of the Invention

This invention relates to shock dampening devices for use in drill strings and, in particular, to an apparatus designed to control the force applied to the drill bit in both vertical and deviated holes by absorbing and decoupling axial vibrations and torsional forces acting upon the drill string.

II. Description of the Prior Art

Severe axial and torsional forces induced into the drilling assembly during drilling operations can cause damage and wear on the components of the drill string including the drilling tool and the various measuring devices. Such forces can be found in both conventional vertical drilling and high angle drilling where the position of the drill bit is critical. In addition, various conditions arise during drilling operations which induce a torsional or axial load into the drilling assembly. Hard rock and sticky earth formations can cause severe axial and torsional forces to be induced to the well string. The use of drag bits or roller cone bits can induce axial vibrations in vertical drilling operations. The frictional forces between the drill pipe and the hole in deviated holes can induce torsional forces thereby making it difficult to determine and control the position of the bit. In each of these cases, the unexpected release of these forces in the drill string can cause the down hole assembly to be slammed against the bottom of the hole.

Various devices have been developed which dampen or absorb the vertical or axial shocks applied to the drill string through the drill bit. Such shock absorbing subs may employ mechanical springs, resilient washers or fluid chambers to dampen or limit relative movement between an inner mandrel and an outer housing. Typically, the outer housing is connected to the bottom hole assembly. Rotational torque may be transmitted from the upper string to the bit by a series of longitudinal splines connecting the housing to the mandrel. While past known shock subs are capable of dissipating small shocks or loads of very short duration and greater magnitude, such devices are not totally satisfactory in absorbing the axial and torsional forces encountered by the well string. In addition, such tools provide no means of controlling the weight on bit in order to precisely determine the position of the bit relative to the bottom of the hole.

In addition to vertical shock loads, it is known that drill strings are subject to torsional forces resulting from rotation of the string. Such forces may result from sudden stopping of the rotary drill string due to bit hang up or over a longer period as a result of friction in deviated holes or in motors utilized with coiled tubing. Attempts have been made to dissipate such radial shock loads by translating such loads to a vertical component which is absorbed by the shock sub assembly of the device. Thus, both radial and vertical shocks must be dissipated by the same assembly which may overwhelm the tool and result in failure, causing damage to the drill string. Moreover, such tools do not provide means for controlling the weight on bit in order to position the bit in the hole.

SUMMARY OF THE PRESENT INVENTION

The present invention overcomes the disadvantages of the prior drill string assemblies by providing an apparatus capable of controlled application of force to the drill bit in both vertical and deviated holes while decoupling the axial vibrations from the torsional forces acting upon the drill string during drilling operations.

The present invention is useful in attenuating vibrations induced by drag bits in conventional drilling, in controlling the position of the bit in high angle drilling, and in absorbing the torsional forces associated with coiled tube drilling and other more conventional drilling operations. Generally, the apparatus embodying the present invention comprises an outer casing connected at its upper end to the drill string and an inner mandrel assembly telescopically received within the casing. The inner assembly is coupled at its lower end to the bottom hole assembly or the drilling tool and includes an axial fluid passageway communicating with the fluid passageway of the drill string in order to provide a controlled means of supplying drilling fluids to the drill bit. An interchangeable pressure control nozzle disposed at the top of the inner mandrel assembly controls the weight on bit.

The inner telescoping assembly includes upper and lower pistons which form an annular fluid chamber therebetween while radially supporting the inner assembly within the outer casing. The upper piston sealed against the casing wall is directly affected by the fluid pressure within the casing. The lower piston is affected by the fluid pressure in the outer annulus surrounding the tool. Upper and lower stops limit the axial movement of the inner assembly relative to the outer casing. The upper and lower pistons, in cooperation with the outer casing which acts as a cylinder, dampen the axial forces associated with the drilling operation. The inner assembly further comprises a torque retractor assembly located between the upper and lower pistons and formed by a pair of matching helically cut surfaces. A clearance between the helical surfaces is provided in order to provide a flow path between upper and lower chambers formed as part of the inner fluid chamber. The helical torque retractor is adapted to separate the torsional forces from the axial forces and to move the drilling bit towards the bottom of the hole to ensure continuous drilling. The helix also act as splines to transfer the rotational motion of the drill string to the drill bit. In a preferred embodiment of the torque retractor, the helix winds in a clockwise direction such that as the drilling tool is rotated the helical torque retractor will tend to force the tool towards a stabilized position in effect absorbing the torsional forces associated therewith. The closed fluid chamber between the pistons also results in a dampening of the torsional forces. A mechanical spring may also be provided to supplement the downward force applied to the bit.

Other objects, features and advantages of the present invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 2:
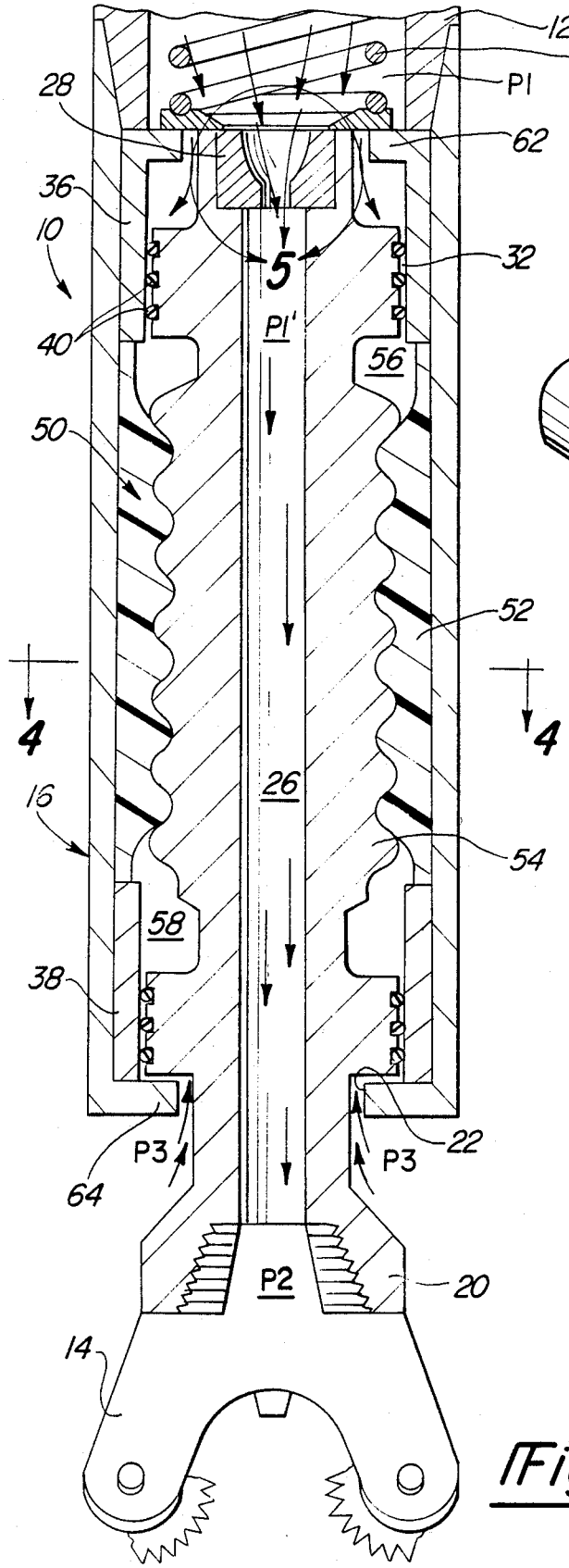
FIG. 2 is a longitudinal cross-sectional view of the present invention in a fully extended position.

Referring to the drawings, there is shown an apparatus 10 embodying the present invention, for the controlled absorption of both axial and torsional forces associated with the drilling work loads applied to a drill string. The apparatus 10 is connected to the lower end of a drill string 12 and preferably has a drill bit 14 connected to the lower end thereof for forming vertical or deviated bore holes. Alternatively, a bottom hole assembly (BHA) may be disposed in the well string either just above or just below the apparatus 10 which helps to isolate the vibrations and other loads from the sensitive instrumentation of the bottom hole assembly. The apparatus 10 embodying the present invention is highly useful in conventional drilling techniques where the object is to attenuate severe vibrations induced by drag bits or the severe axial vibrations induced by roller cone drill bits. However, the apparatus 10 is also utilized in high angle or deviated hole drilling where it is difficult to control and determine the position of the bit in the hole due to the friction forces between the pipe and the hole. Such friction can be caused by a tight deviation radius or simply the drill string assembly dragging in the hole which can cause the assembly to compress as weight is placed on the string. In a still further application, the apparatus 10 may be used with coiled tubes which are subject to substantial torsional forces.

Figure 1:
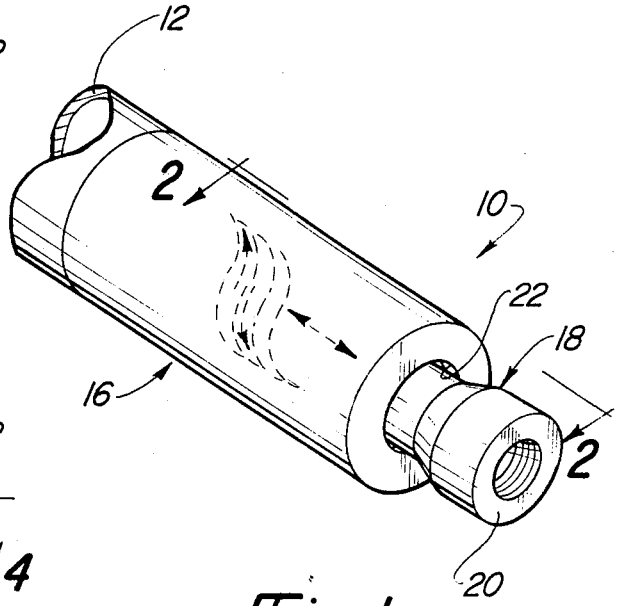
FIG. 1 is an elevational perspective of the apparatus embodying the present invention.
Figure 3:
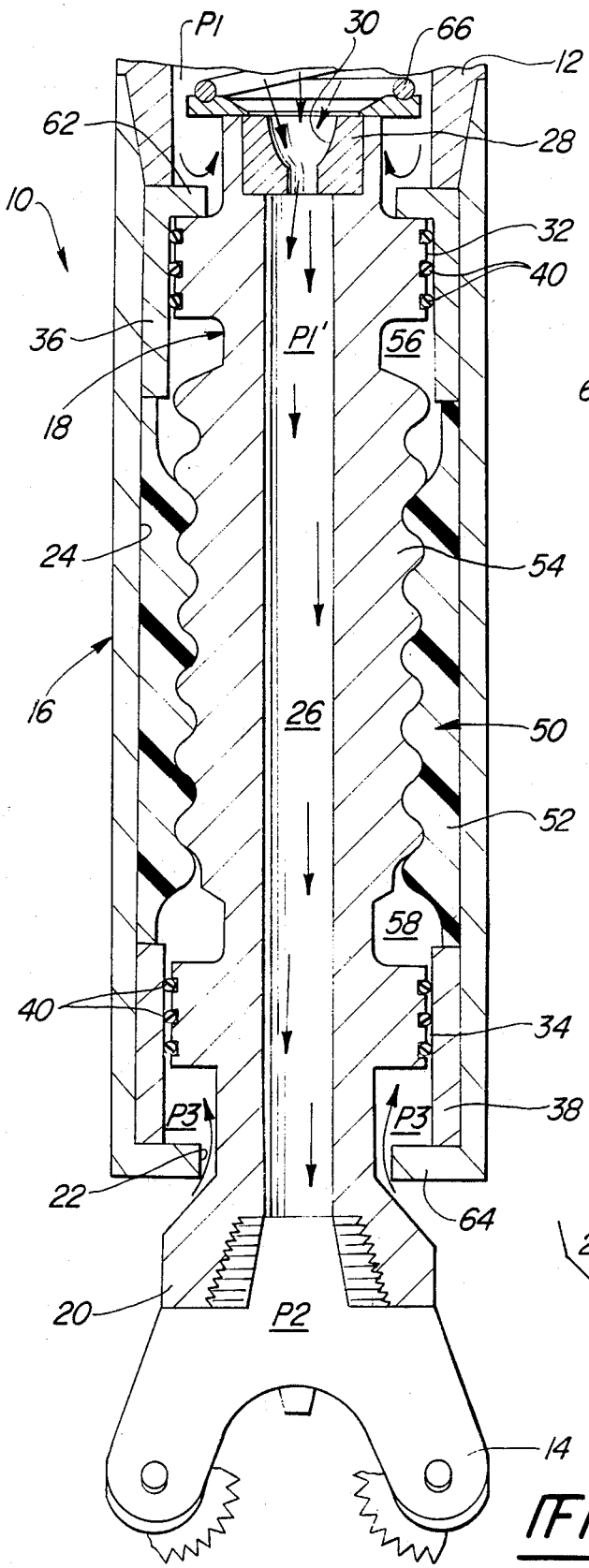
FIG. 3 is a longitudinal cross-sectional view of the present invention in a compressed position.

Referring now to FIGS. 1 through 3, the apparatus generally comprises an outer casing 16 which is connected at its upper end to the drill string 12 and an inner mandrel assembly 18 which is telescopically received within the outer casing 16 and has the drill bit 14 connected to the bit box 20 formed at the lower end thereof. The outer casing 16 includes an axial opening 22 formed at the lower end through which the inner mandrel 18 extends. However, the opening 22 is large enough to permit the downhole fluids to flow into the casing 16 to provide a counteractive pressure as will be subsequently described. The outer casing 16 has a substantially cylindrical configuration similar to the configuration of the drill string 12 with a cylindrical inner surface 24 for telescopingly receiving the inner mandrel assembly 18.

Figure 4:
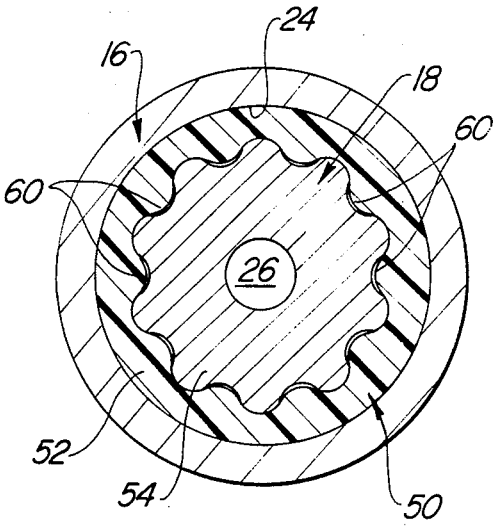
FIG. 4 is a lateral cross-sectional view taken along line 4—4 of FIG. 1.
Figure 5:
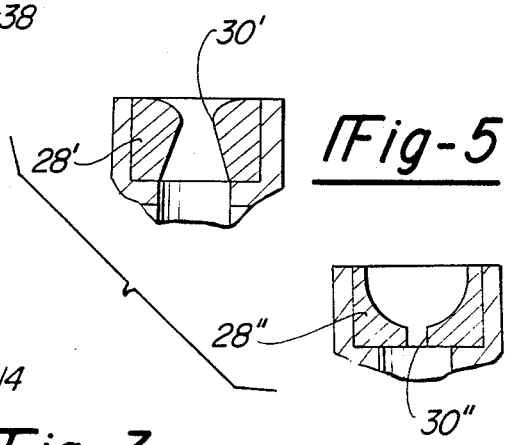
FIG. 5 is a cross-sectional perspective of alternative embodiments of the pressure control nozzle utilized in the present invention.

Referring to FIGS. 2–4, the inner mandrel assembly 18 includes an axial fluid passageway 26 adapted to provide fluid communication between the drill string 12 and the bit 14 in order to supply drilling fluid for the operation of the bit 14. The fluid passageway 26 is smaller than the inner passageway of the drill string 12 and therefor provides a restricted flow of drill fluids to the bit 14. A flow or pressure control nozzle 28 is mounted at the upper end of the passageway 26 to provide a controlled restriction of the fluid flow through passageway 26 and thereby create a known static pressure P1 across the top of the inner mandrel assembly 18. In one embodiment of the present invention, the control nozzle 28 is interchangeable to vary the restrictive passage 30 formed at the upper end of the fluid passageway 26. In addition to the control nozzle 28 shown in FIG. 2, FIG. 5 shows alternate control nozzles 28' and 28'' which may be utilized under varying conditions. Each of these nozzles 28' and 28'' provide different restrictive openings 30' and 30'' Whichever nozzle configuration is utilized, the static pressure P1 across the top of the inner mandrel assembly 18 can be calculated and is therefore known. In a still further embodiment, the interchangeable nozzle 28 can be replaced with a variable opening assembly which could be varied by a valve linkage attached to the casing 16 or a valve controlled by a downhole formation evaluation system. In this manner, the restrictive opening 30 could be continuously adjusted to increase the flow resistance and therefore the pressure P1 exerted on the inner mandrel assembly 18 in response to varying downhole conditions. With either embodiment, a known fluid pressure P1, is produced within the fluid passageway 26 as well as a known fluid pressure P2 across the bit 14.

The inner mandrel assembly 18 further includes an upper piston 32 and a lower piston 34 which sealingly engage the inner surface 24 of the outer casing 16. Preferably, the outer casing 16 includes an upper cylinder liner 36 and a lower cylinder liner 38 disposed within the casing 16 to form cylinders for the pistons 32 and 34. In order to ensure sealing engagement between the respective piston and cylinder wall, the pistons 32 and 34 may be provided with O-ring seals 40. In this manner, the upper and lower pistons form a chamber within the casing 16 which is sealingly isolated from the drilling fluid supplied through the drill string 12 and the environmental fluids within the hole. Whereas the drilling fluid exerts a pressure P1 on the upper piston 32, the downhole fluid, which is allowed to flow into the casing 16 through the opening 22, exerts a fluid pressure P3 on the lower piston 34. In addition to forming the inner chamber, the pistons and cylinder linings cooperate to provide radial support for the inner mandrel assembly 18 within the casing 16.

Disposed within the chamber of the casing 16 formed by the upper and lower pistons is a torque retractor assembly 50 adapted to isolate the torsional forces associated with the drilling operation. The torque retractor assembly 50 generally comprises an outer member 52 which matingly receives an inner member 54. In a preferred embodiment of the present invention, the inner member 54 is an integral portion of the inner mandrel assembly 18 formed between the pistons 32 and 34 and having the fluid passageway 26 extending therethrough. Similarly, in a preferred embodiment, the outer member 52 is in the form of a substantially tubular sleeve which is bonded to the inner surface 24 of the casing 16 between the cylinder linings 36 and 38. As a still further embodiment, the outer member 52 may be bonded to a steel cylindrical liner which is in turn attached to the inner surface 24 of the casing 16.

The inner and outer members of the torque retractor assembly 50 are provided with matched surface profiles having mating helically cut surfaces. The surfaces are formed by a series of smooth curves which form a substantially sinusoidal cross-sectional configuration. The multistart helical surfaces may include anywhere from six to twelve helices formed in parallel and having a helix angle of between 30° and 80°, preferably approximately 60°, to ensure that the helix always has an upward component. If the helix angle is too shallow, an extraordinary amount of vertical force will be necessary to induce the telescoping movement. If the angle is too steep, sliding between the components will be uncontrolled. Because of the mating helical surfaces of the inner member 54 and the outer member 52, one of the members must be made of an elastomeric material while the other is formed of metal to allow some give. In a preferred embodiment, the outer sleeve member 52 is made of an elastomer while the integrity of the inner mandrel assembly 18 is maintained by manufacturing it from metal. In addition, the torque retractor members 52 and 54 are provided with a sliding clearance to allow the lubricating fluid disposed within the chamber to flow between the helical surfaces.

The torque retractor assembly 50 divides the inner chamber formed by the pistons 32 and 34 into an upper fluid chamber 56 and a lower fluid chamber 58. A plurality of fluid passageways 60 are provided to allow fluid communication between the upper and lower fluid chambers in addition to the sliding clearance between the inner member 54 and the outer member 52. In a preferred embodiment, the fluid passageways 60 parallel the helical cuts of the torque retractor assembly 50 and are formed by increasing the depth of the channel between helices of the inner torque retractor member 54. As an alternative or to supplement fluid transfer between the lower and upper chambers, a bypass fluid passageway may be provided through the inner member 54. Thus, as the inner mandrel assembly 18 travels within the outer casing 16, the lubricating fluid will be transferred between the upper chamber 56 and the lower chamber 58 in order to hydraulically dampen the movement of the inner assembly 18.

In order to limit the travel of the inner mandrel assembly 18 within the casing 16, an upper stop 62 and a lower stop 64 are provided to selectively engage the respective piston and thereby stop further travel. In addition, a supplemental compression spring 66 may be provided for supplemental downward force on the inner mandrel assembly 18 to inhibit telescoping movement. The spring 66 may be utilized to inhibit movement throughout the stroke of the inner mandrel assembly 18 within the casing 16 or only towards the limiting extent of movement.

The apparatus 10 of the present invention operates to absorb or isolate the torsional forces associated with drilling work from the axial forces associated with the drilling work. Axial forces are caused, for example, by the drill bit 14 hitting the bottom of the hole while torsional forces may be caused by nonsynchronous rotation of the drill bit and the drill string. The fluid pressure differentials within the drill string 12 and the apparatus 10 not only dampen or counteract forces on the bit but also determine the weight on bit which determines the drilling force of the bit 14. The static pressure P1 across the upper piston 32 and the top of inner mandrel assembly 18 is proportional to the square of the fluid flow which is directly proportional to the specific gravity of the drilling fluid and will be increased by the viscosity of the drilling fluid. Since the static pressure at the top of the hole is a function of the pressure drop at the drill bit, the weight on bit can be readily determined. The approximate pressure force is a function of the inlet pressure P1 of the control nozzle 28 minus the pressure drop P1' across the control nozzle 28 and the pressure drop across the drill bit P2. The pressure drop P3 in the outer annulus acts upwardly against the lower piston 34 to counteract some of the fluid pressure P1 within the drill string 12.

Typically, prior to commencement of drilling, the hydrostatic force of the drilling fluid will fully extend the apparatus 10 such that the lower piston 34 engages the lower stop 64 as shown in FIG. 2. In this position, the lower fluid chamber 58 will contain a larger proportion of the lubricating fluid than upper fluid chamber 56. When the bit 14 reaches the formation, the upward force from the drilling tool will cause the inner assembly 18 to move into the casing 16 against the fluid pressure P1, the dampening effect of the fluid from the lower chamber 58 being forced through the passageways 60 into the upper chamber 56, and interaction of the cooperating helical surfaces of the outer member 52 and the inner member 54. It is important that the helical surfaces on the retractor assembly be clockwise so that as the drill string is rotated the apparatus 10 moves the drill bit 14 back towards the bottom of the hole. The clockwise helix will cause an upward reaction of the inner assembly 18 which will immediately be compensated for thereby ensuring that the drill bit 14 is in constant contact with the formation and eliminating the build-up of force which can release causing the drill bit to be slammed against the bottom of the hole. Thus, while axial forces are primarily absorbed by the fluid dampening affect of the pistons, torsional forces are primarily dampened by the cooperating helical surfaces of the torque retractor 50 which are wound in a direction opposite to the direction of rotation. Nevertheless, the fluid balancing within the torque retractor 50 will supplement absorption of the torsional forces by moving the helical surfaces towards a balanced position. It is this cooperation between the helical members of the torque retractor 50 and the pressure balance within the apparatus which results in the absorption of the torsional forces as well as the axial forces. The apparatus 10 of the present invention provides for the controlled application of a predetermined drilling force by absorbing the axial and torsional forces associated with the drilling operation. By providing an enhanced method of controlling the weight on bit while absorbing the associated forces, the useful life of the drilling equipment is extended, particularly sensitive equipment such as the bottom hole assembly, the measuring-while-drilling unit, or even the drill bit itself.

The foregoing detailed description has been given for clearness of understanding only and no unnecessary limitations should be understood therefrom as some modifications will be obvious to those skilled in the art without departing from the scope or spirit of the appended claims.

I claim:

1. An apparatus for the controlled absorption of axial and torsional forces associated with the drilling work loads applied to a drill string, said apparatus adapted for series connection in a drill string to formation cutting means, said apparatus comprising:

an outer casing connected at its upper end to the drill string, said outer casing having an axial opening formed at its lower end;

an inner mandrel assembly having the formation cutting means connected to the lower end thereof and an axial fluid passageway for the controlled supply of drilling fluid from the drill string to the formation cutting means, said inner assembly telescopingly received in said outer casing such that the lower end of said assembly extends through said axial opening of said outer casing;

upper and lower pistons on said inner assembly adapted to sealingly engage an inner surface of said outer casing, said pistons forming an enclosed fluid chamber therebetween; and a torque retractor assembly disposed within said fluid chamber between said upper and lower pistons, said torque retractor assembly adapted to absorb the torsional forces associated with said drill string.

2. The apparatus as defined in claim 1 wherein said torque retractor assembly comprises a pair of mating helical members, the outer helical member forming said inner surface of said outer casing and the inner helical member forming the outer surface of said inner mandrel assembly between said upper and lower pistons, said torque retractor assembly dividing said fluid chamber into an upper fluid chamber and a lower fluid chamber.

3. The apparatus as defined in claim 2 wherein said torque retractor assembly includes at least one fluid passageway formed between said inner and outer helical members to provide fluid communication between said upper and lower fluid chambers.

4. The apparatus as defined in claim 3 wherein said pair of mating helical members include matching multi-start helically cut surfaces having a substantially sinusoidal surface configuration.

5. The apparatus as defined in claim 4 wherein said torque retractor assembly includes a plurality of fluid passageways formed parallel to said helical cuts of said helical members.

6. The apparatus as defined in claim 4 wherein one of said pair of mating helical members is made of an elastomeric material.

7. The apparatus as defined in claim 2 wherein said outer helical member comprises a substantially tubular structure bonded to the inner surface of said outer casing.

8. The apparatus as defined in claim 1 wherein said outer casing includes a first cylinder lining adapted to sealingly engage said upper piston and a second cylinder lining adapted to sealingly engage said lower piston, said cylinder linings mounted to said inner surface of said outer casing.

9. The apparatus as defined in claim 8 wherein said outer casing includes upper and lower stops adapted to selectively engage said upper and lower pistons to limit the telescoping movement of said inner mandrel assembly within said casing.

10. The apparatus as defined in claim 1 and further comprising a pressure control nozzle mounted at the upper end of said axial fluid passageway in said inner mandrel assembly, said nozzle controlling the supply of drilling fluid to the formation cutting means and thereby the fluid pressure applied to said upper piston.

11. The apparatus as defined in claim 10 wherein said pressure control nozzle is interchangeable to vary the drilling fluid supply to said formation cutting means and the fluid pressure against said upper piston.

12. The apparatus as defined in claim 10 wherein said fluid passage of said pressure control nozzle can be variably restricted.

13. The apparatus as defined in claim 10 wherein said formation cutting means comprises a drill bit assembly attached to the end of said inner mandrel, said fluid passageway supplying drilling fluid to said drill bit.

14. An apparatus for the controlled absorption of axial and torsional forces associated with the drilling work loads applied to a drill string, said apparatus adapted for series connection in a drill string with a bottom hole assembly having a drill bit, said apparatus comprising:

an outer casing connected at its upper end to the drill string, said outer casing having an axial opening formed at its lower end;

an inner mandrel assembly having the bottom hole assembly connected to the lower end thereof, said inner assembly telescopingly received in said outer casing such that the lower end of said assembly extends through said bottom opening of said outer casing, said inner assembly comprising:

an axial fluid passageway for the controlled supply of drilling fluids from the drill string to the bottom hole assembly and drill bit, said axial fluid passageway having an interchangeable pressure control nozzle mounted at the upper end of said passageway to vary the fluid pressure supplied to the bottom hole assembly;

upper and lower pistons adapted to sealingly engage an inner surface of said outer casing, said pistons forming an enclosed fluid chamber therebetween, said upper piston being exposed to the drilling fluid pressure from said drill string and said lower piston being exposed to the downhole fluid pressure environment through said bottom opening in said outer casing, said pistons adapted to absorb the axial load forces associated with said drill string;

a torque retractor assembly adapted to absorb the torsional load forces associated with said drill string and disposed within said fluid chamber between said upper and lower pistons, said torque retractor assembly including an outer member having a helically cut surface with a substantially sinusoidal surface configuration, said outer member forming the inner surface of said outer casing, and a mating inner member having a mating helically cut surface with a substantially sinusoidal surface configuration, said inner member forming the outer surface of said inner mandrel assembly between said upper and lower pistons.

15. The apparatus as defined in claim 14 wherein said matching helical surfaces of said inner and outer retractor assembly members include a plurality of helical cuts to provide multi-start helically cut surfaces.

16. The apparatus as defined in claim 15 wherein said torque retractor assembly divides said fluid chamber into an upper and a lower chamber, said retractor assembly having a plurality of helical fluid passageways formed parallel to said helical cuts to provide fluid communication between said upper and lower fluid chambers.

17. The apparatus as defined in claim 16 wherein one of said retractor assembly members is made of an elastomeric material.

18. The apparatus as defined in claim 17 wherein said outer retractor member comprises a tubular sleeve mounted to said inner surface of said outer casing and said inner retractor member forms an integral portion of said inner mandrel assembly.

19. The apparatus as defined in claim 18 wherein said outer casing includes a first cylinder lining adapted to sealingly engage said upper piston and a second cylinder lining adapted to sealingly engage said lower piston, said cylinder linings mounted to said inner surface of said casing with said outer retractor member disposed therebetween.

20. The apparatus as defined in claim 19 wherein said outer casing includes upper and lower stops which selectively engage said upper and lower pistons to limit the telescoping movement of said inner mandrel assembly within said outer casing.

21. The apparatus as defined in claim 20 and further comprising compression spring means disposed within said outer casing and adapted to engage the upper end of said inner mandrel assembly to provide supplemental absorption of axial loads on said drill string.

22. The apparatus as defined in claim 17 wherein said fluid chamber is filled with a lubricating fluid to provide lubrication between said inner and outer surfaces of said torque retractor assembly.

* * * * *